United States Patent [19]

Albanese et al.

[11] 4,456,635

[45] Jun. 26, 1984

[54] INTERMITTENTLY APPLIED COATING OF MAGNESIUM HYDROXIDE TO BOILER TUBES TO PREVENT SLAG AND DEPOSIT BUILDUP

[75] Inventors: Vincent M. Albanese, Lisle, Ill.; Andrew G. Keleher, Scottsdale, Ariz.

[73] Assignee: Nalco Chemical Company, Oak Brook, Ill.

[21] Appl. No.: 453,198

[22] Filed: Dec. 30, 1982

[51] Int. Cl.[3] ..... B05D 7/22

[52] U.S. Cl. ..... 427/230; 134/22.13; 427/236; 427/238

[58] Field of Search ..... 427/230, 236, 238, 239, 427/427; 134/2, 4, 22.1, 22.11, 22.13, 22.12, 22.17

[56] References Cited

U.S. PATENT DOCUMENTS

| | | | |
|---|---|---|---|
| 3,093,496 | 6/1963 | Demaison | 427/236 |
| 3,093,497 | 6/1963 | Demaison | 427/427 |
| 3,467,549 | 9/1969 | Bartek | 134/2 |

FOREIGN PATENT DOCUMENTS

| | | | |
|---|---|---|---|
| 56-109822 | 8/1981 | Japan | 427/427 |
| 820989 | 9/1959 | United Kingdom | 134/22.13 |

*Primary Examiner*—S. L. Childs

*Attorney, Agent, or Firm*—John G. Premo; Robert A. Miller; Donald G. Epple

[57] ABSTRACT

Coating a thin film of magnesium hydroxide on the radiant section of the furnace walls of boilers prevents slagging and controls ash buildup.

2 Claims, No Drawings

INTERMITTENTLY APPLIED COATING OF MAGNESIUM HYDROXIDE TO BOILER TUBES TO PREVENT SLAG AND DEPOSIT BUILDUP

INTRODUCTION

In high pressure boilers such as those used by utilities, refineries, and the like, ash and slag deposits build up in the radiant furnace section of these units. The tubes of these units frequently become heavily encrusted with ash and slag. The cause of these deposits is the inorganic portions of fossil fuels such as coal, or residual oils which result from the refining of petroleum.

Unless these undesirable deposits are controlled, they can cause several undesirable problems. For instance, they can produce forced outages, poor unit efficiencies, damage, increased maintenance costs, and cause poor electrostatic precipitator collection.

Several solutions towards preventing excessive buildup of slag and ash have been suggested or practiced. Some of these include increased soot blowing, changing air levels, reducing boiler load, mechanical cleaning during downtime, and the use of chemical treatments which are added to the residual fuel. None of these treatments have been entirely satisfactory in preventing the buildup of ash and slag.

One of the most commonly used fossil fuels is coal. Coals can produce 2 types of ash, 1 being acidic with the other being basic. The degree of basicity or acidity of the coal ash determines the fusion temperature of the ash-forming materials which can range between about 2,000° up to as high as 3,000° F. Thus, it is apparent that ash is not a simple material and varies widely in its composition and fushion temperature.

It would be of great benefit to the art if it were possible to provide a chemical treatment to prevent the radiant section of furnace walls of boilers from having large amounts of ash and slag buildup occurring.

Of further benefit would be the utilization of an inexpensive chemical that could be readily applied directly to the area affected by ash deposits in the form of an aqueous slurry.

THE INVENTION

A method of preventing slag and ash deposit buildup on the radiant section of the furnace walls of fossil fuel fired boilers which comprises intermittently maintaining on the surfaces of said radiant section of the furnace walls a thin film of magnesium hydroxide.

The Magnesium Hydroxide Slurry

It is preferred to utilize in the practice of the invention a concentrated slurry of magnesium hydroxide. It is preferable that the slurry contain between 20 up to about 60% by weight of magnesium hydroxide. Preferably, the slurry should contain about 50% by weight.

The particle size of the magnesium hydroxide should be finer than about 30–50 mesh, U.S. standard sieve size. The finer the particle size of the magnesium hydroxide, the more stable will be the slurry. To promote stability of the suspension, suspending agents such as the water-miscible cellulose ethers and the gum such as Xanthomonas may be utilized. There are optional ingredients, but when used, the amount is between 0.5–2% by weight of the slurry.

Application of the Slurry

Application of the slurry to the radiant section of the furnace walls of the boiler is done under pressure so that the slurry may be applied from a port in the furnace which allows visual access to the radiant section. The amount of pressure used to apply the slurry may vary. It should be sufficient to overcome the gas currents normally caused by fans and convection currents present in the furnace section of the boiler.

A typical application of the slurry would utilize a diaphragm pump operating from about 150 psi of compressed air. The inlet port of the pump would be placed in to either a 55 gallon drum or a large storage container. A high pressure nozzle would then be placed in a port located in, for example, a furnace door which would also be near a viewing port to allow uniform application of the chemical to the radiant section of the furnace area of the boiler. The magnesium hydroxide slurry is sprayed directly onto the tubes of the boiler.

Dosage of the Slurry

A typical dosage rate would be 54 square feet of tube area per gallon of 50% magnesium hydroxide slurry. The dosage may be greater or less than this amount with the main criteria being the maintenance of a thin film of magnesium hydroxide on the tubes. The maintenance of this film can be achieved by routine experimentation. Application of the slurry to the tube area may require coating once to twice a day or it may be required only once or twice a week depending on the severity of the ash and slag problems.

The magnesium hydroxide survives the firebox environment and coats the tubes while the boiler is operating. The coating prevents the strong adhesion of ash to the tubes' surfaces. Then ash buildup falls from the tubes by gravity or by flue gas momentum.

While the invention is particularly useful in treating coal-fired boilers, it also prevents ash and slag deposits when the fossil fuel utilized in a residual petroleum oil such as No. 6 or Bunker C fuel.

The invention has the ability to prevent the buildup of ash and slag deposits in boilers in the fireside section of these units. The fireside sections include not only the furnace walls but also all superheating, reheating, and water heating heat transfer areas in the furnace. Thus, the expression, "the radiant section of furnace walls," includes these additional areas of the fireside portion of boilers. The term, "furnace walls," is used synonymously with the term, "tubes."

While the expression, "coating of magnesium hydroxide," has been employed, it is understood that this includes any chemical change that occurs due to the contact of the starting slurry with the heat generated in the boiler. Thus, the coating could well be composed of 1 or more oxides of magnesium chemically combined with components found in the ash that normally would form without treatment.

EXAMPLES

To illustrate the invention, the following are presented by way of example.

At a midwestern utility firing high sulfur coal, a severe furnace slagging situation existed. In an attempt to control the slagging problem, the utility was firing with 6.0–7.0% excess oxygen to cool the furnace, and they also were curtailing production at night in order to hydrostatically remove the frozen slag deposits. 200 psi water was used as the blasting medium. This deslagging operation occured with nearly daily frequency. Boiler cycle efficiency suffered approximately 2% by the overuse of excess oxygen to cool the furnace.

Test 1

The invention was applied to the slag area (around 4000 square feet of radiant wall) once per day after the deslagging operation. Approximately 75 gallons of the invention was utilized each day (the product being a magnesium hydroxide slurry which is 50% solids and using an aqueous carrier). As a part of the test, excess oxygen was reduced in 0.5% daily decrements. This is a severe test because the correspondingly higher heat input to the furnace would cause severe slagging conditions. The furnace remained clean after chemical application despite these severe conditions. As a final practical limit on the final test day, 3.5% excess oxygen was utilized to fire the unit. The furnace remained clean under these conditions.

Test 2

As a more severe test, the boiler was operated for a full week period at full operating capacity. No deslagging operation was employed during any day of that week. Each morning 75 gallons of the magnesium hydroxide slurry used in the invention was applied to the slagging area. Excess oxygen was maintained at 3.5%. The furnace still remained clean and the utility realized considerable cycle efficiency improvement.

We claim:

1. A method of preventing slag and ash deposit buildup on the radiant section of the furnace walls of fossil fuel fired boilers which comprises intermittently maintaining on the surfaces of said radiant section of the furnace walls a thin film of magnesium hydroxide.

2. The method of claim 1 where the fossil fuel is coal.

* * * * *